United States Patent [19]

Suguro et al.

[11] 4,454,521

[45] Jun. 12, 1984

[54] DIAZO-TYPE THERMOSENSITIVE RECORDING MATERIAL

[75] Inventors: Yoshihiro Suguro, Mishima; Masanaka Nagamoto, Sunto; Takanori Motosugi; Yoshihiko Hotta, both of Numazu; Toshiyuki Watanabe, Mishima, all of Japan

[73] Assignee: Ricoh Company, Ltd., Tokyo, Japan

[21] Appl. No.: 356,076

[22] Filed: Mar. 8, 1982

[30] Foreign Application Priority Data

Mar. 14, 1981 [JP] Japan ..... 56-37091

[51] Int. Cl.[3] ..... B41M 5/18; B41M 5/22

[52] U.S. Cl. ..... 346/208; 346/209; 346/211; 346/212; 346/214; 346/218; 346/226

[58] Field of Search ..... 106/21; 282/27.5; 427/150–152; 428/320.4, 320.6, 320.8, 488, 411, 537, 913, 914; 430/176; 346/135.1

[56] References Cited

U.S. PATENT DOCUMENTS 4,245,857 1/1981 Satomura ..... 428/320.6

4,255,491 3/1981 Igarashi ..... 282/27.5

FOREIGN PATENT DOCUMENTS 55-3919 1/1980 Japan ..... 282/27.5

57-157788 9/1982 Japan ..... 428/320.4

*Primary Examiner*—Bruce H. Hess

*Attorney, Agent, or Firm*—Flynn, Thiel, Boutell & Tanis

[57] ABSTRACT

A diazo-type thermosensitive recording material comprising a diazo-type thermosensitive coloring layer formed on a support material, the diazo-type thermosensitive coloring layer comprising a diazo compound, a coupler capable of forming an azo dye in the reaction between the diazo compound and the coupler, and a petroleum resin with a melting or softening point ranging from 50° C. to 150° C., and with the addition of auxiliary components for improving the properties of the thermosensitive recording material. By the use of such a petroleum resin in the thermosensitive coloring layer, the diazo compound and the coupler are separated from each other, and the coloring reaction between the two is prevented during storage, so that excellent preservation over a long period is attained, while when image formation is done by heat application, the coupling reaction between the diazo compound and the coupler is accelerated due to the low melting point of the petroleum resin present in the thermosensitive coloring layer, whereby efficient thermal response to thermal heads is attained.

15 Claims, No Drawings

DIAZO-TYPE THERMOSENSITIVE RECORDING MATERIAL

BACKGROUND OF THE INVENTION

The present invention generally relates to a thermosensitive recording material, and more particularly to a diazo-type thermosensitive recording material capable of fixing images by light exposure. In the thermosensitive recording material according to the present invention, image formation is done by a thermal head which is heated to a predetermined temperature. The thermosensitive recording material which bears the thus formed images is exposed to light. By this exposure, the non-image area, that is, the background of the thermosensitive recording material, loses its thermosensitivity, and no image can be formed any longer even if heat is applied thereto later on, whereby the images formed on the thermosensitive recording material can be fixed permanently.

Conventionally, thermosensitive recording materials are used as copying materials for books or documents; output recording sheets for computers, facsimile apparatus and medical analytical instruments; thermosensitive-recording-type magnetic tickets; and thermosensitive-recording-type labels.

Because of the ease of automatic recording with thermosensitive recording materials, it would be advantageous to use thermosensitive recording materials for preparing securities, merchandise coupons, entrance tickets, certificates, payment slips and the like. However, in these fields, high recording reliability is required. In other words, it is required that the recorded images be capable of being made permanent and that it be impossible to record additions to the already recorded information, and, thus, that recorded matter on such thermosensitive recording materials not be alterable. Otherwise, reliability of the record cannot be obtained.

Conventionally, as an image-fixable thermosensitive recording material, a diazo-type thermosensitive recording material is known, which utilizes the coloring reaction between a diazo compound and a coupler.

However, the conventional diazo-type thermosensitive recording material cannot be used in practice because of (1) slow thermal response when a thermal head is employed, and (2) poor preservability of the material itself and of the images formed thereon.

Recently, a thermosensitive recording material has been sought which would allow rapid recording in facsimile apparatus, computers and medical analytical instruments. Especially in the field of facsimiles, a thermosensitive recording material suitable for rapid recording is required so that communication costs can be minimized.

SUMMARY OF THE INVENTION

It is therefore an object of the present invention to provide a diazo-type thermosensitive recording material comprising a diazo-type thermosensitive coloring layer formed on a support material, with efficient thermal response to thermal heads and excellent preservation over a long period.

The diazo-type thermosensitive coloring layer comprises a diazo compound, a coupler capable of forming an azo dye in the reaction between the diazo compound and the coupler, and a petroleum resin, and, if necessary, with the addition of auxiliary components for improving the desired properties of the thermosensitive recording material.

The diazo-type thermosensitive coloring layer can be made into a single layer or multiple layers. In the former case, all of the above-mentioned components are contained in that single layer, while in the latter case, the above-mentioned components are contained separately in those multiple layers.

One of the key features of the diazo-type thermosensitive recording material according to the present invention is that a petroleum resin is contained in the thermosensitive coloring layer.

By the use of a petroleum resin in the thermosensitive coloring layer, the diazo compound and the coupler are separated from each other, and the coloring reaction between the two is prevented during storage. As a result, the thermosensitive recording material according to the present invention can be stored for a long period of time. On the other hand, when image formation is done by heat application, the coupling reaction between the diazo compound and the coupler is accelerated due to the low melting point of the petroleum resin present in the thermosensitive coloring layer, whereby the thermal response to a thermal head is significantly improved in comparison with the thermal response of the conventional thermosensitive recording materials.

DETAILED DESCRIPTION OF THE PREFERRED EMBODIMENTS

A diazo-type thermosensitive recording material according to the present invention comprises a diazo-type thermosensitive coloring layer formed on a support material, the diazo-type thermosensitive coloring layer comprising a diazo compound, a coupler capable of forming a diazo dye in the reaction between the diazo compound and the coupler, and a petroleum resin, and, if necessary, with the addition of auxiliary components for improving the desired properties of the thermosensitive recording material.

The diazo-type thermosensitive coloring layer can be made into a single layer or multiple layers. In the former case, all of the above-mentioned components are contained in that single layer, while in the latter case, the above-mentioned components are contained separately in those multiple layers.

One of the key features of the diazo-type thermosensitive recording material according to the present invention is that a petroleum resin is contained in the thermosensitive coloring layer.

Due to the presence of a petroleum resin in the thermosensitive coloring layer, the diazo compound and the coupler are separated from each other and, therefore, the coloring reaction between the two is prevented during storage. As a result, the thermosensitive recording material can be stored over a long period of time. On the other hand, when image formation is done by heat application, the coupling reaction between the diazo compound and the coupler is accelerated due to the low melting point of the petroleum resin present in the thermosensitive coloring layer, whereby the thermal response to a thermal head is significantly improved in comparison with the conventional thermosensitive recording material.

In the present invention, for example, the following petroleum resins can be used for the above described purpose:

(1) Petroleum resin (copolymer of $C_8$–$C_{10}$ aromatic hydrocarbon fractions and acrylonitrile);
(2) Petroleum resin (copolymer of dicyclopentadiene and maleic anhydride);
(3) Decanolated petroleum resin (hydrolyzed copolymer of $C_{13}$ hydrocarbon fractions and acrylonitrile);
(4) Petroleum resin (turpentine oil copolymer);
(5) Petroleum resin (copolymer of cyclopentadiene and dicyclopentadiene);
(6) Petroleum resin (cumarone-indene copolymer);
(7) Hydrogenated petroleum resin ($C_4$–$C_{10}$);
(8) Maleic petroleum resin ($C_4$–$C_{10}$);
(9) Petroleum resin ($C_5$ hydrocarbon fraction polymer);
(10) Petroleum resin (isoprene dimer);
(11) Petroleum resin (polymer of $C_8$–$C_{10}$ aromatic hydrocarbon fractions);
(12) Petroleum resin (copolymer of $C_4$–$C_5$ hydrocarbon fraction and $C_8$–$C_{10}$ aromatic hydrocarbon fractions); and
(13) Petroleum resin [copolymer of $C_4$–$C_5$ hydrocarbon fraction and styrene type compounds (for instance, styrene, α-methylstyrene and vinyltoluene)].

The above are examples of petroleum resins that can be employed in the present invention. With respect to the use of petroleum resins, the present invention is not limited to the above petroleum resins.

In the present invention, the oligomers of petroleum resins with a "number-average" molecular weight ranging from 300 to 3000, preferably with a "number-average" molecular weight ranging from 500 to 2000, are employed. For use in the present invention, it is required that the softening point of the petroleum resins be in the range of 50° C. to 150° C.

These petroleum resins are commercially available. Examples of such petroleum resins are as follows:

Escorez (made by Tonen Sekiyukagaku K.K.) which is an aliphatic petroleum resin; Hi-rez (made by Mitsui Petrochemical Industries, Ltd.), which is also an aliphatic petroleum resin; Quintone (made by Nippon Zeon Co., Ltd.), which is a cyclopentadiene-type petroleum resin; Petrosin (made by Mitsui Petrochemical Industries, Ltd.), which is an aromatic petroleum resin; Neopolymer (made by Nisseki Jushi Kagaku, Co., Ltd.), which is also an aromatic petroleum resin; Hiresin (made by Toho Sekiyu Jushi, Co., Ltd.), which is an aliphatic-copolymer-type petroleum resin; and Arkon (made by Arakawa Kagaku Kogyo, Co., Ltd.) which a saturated-alicyclic-type petroleum resin.

In the present invention, when the thermosensitive coloring layer comprises two separate layers, that is, a diazo compound layer and a coupler layer, or when the thermosensitive coupling layer further comprises an intermediate layer between the diazo compound layer and the coupler layer, the petroleum resin is added to at least one of those layers. When the thermosensitive coloring layer consists of a single layer, the petroleum resin is contained in that layer, together with the diazo compound and coupler.

The amount of the petroleum resin employed in the thermosensitive coloring layer is in the range of 0.2 to 5.0 parts by weight, preferably in the range of 0.5 to 2.0 parts by weight, with respect to 1 part by weight of all the other solid components contained in the thermosensitive coloring layer.

Examples of diazo compounds used in the above-mentioned type recording materials are as follows:

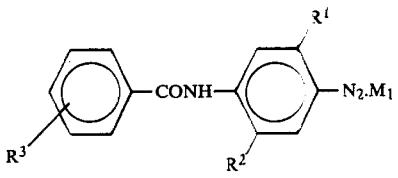

I)

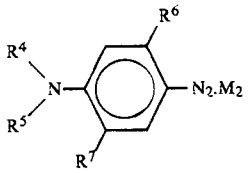

II)

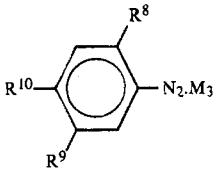

III)

In general formulae (I), (II) and (III), $R^1$, $R^6$ and $R^8$ each represent hydrogen, a halogen, an alkyl group or alkoxy group having one to five carbon atoms,

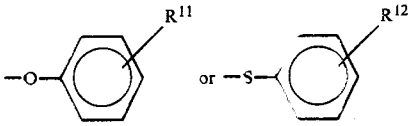

(where $R^{11}$ and $R^{12}$ are the same as $R^2$);

$R^2$, $R^3$ and $R^9$ each represent hydrogen, a halogen, or an alkyl or alkoxy group having one to five carbon atoms;

$R^4$ and $R^5$ represent identical or different alkyl groups or hydroxyalkyl groups with one to five carbon atoms, or

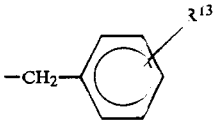

(where $R^{13}$ is hydrogen, an alkyl or alkoxy group having one to three carbon atoms or a halogen);

$R^7$ represents hydrogen, a halogen, a trifluoromethyl group, an alkyl or alkoxyl group having one to five carbon atoms, or

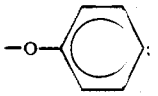

$R^{10}$ represents

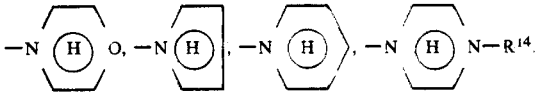

-continued

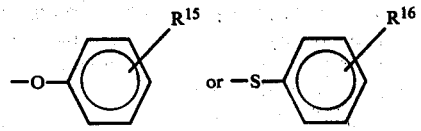

(where $R^{14}$, $R^{15}$ and $R^{16}$ are the same as $R^{13}$); and $M^1$, $M^2$ and $M^3$ each represent an acidic residue or an acidic residue in the form of a double salt in combination with a metallic salt. As the first-mentioned acidic residue, a halogen ion and an anion of fluorine-containing inorganic acids, such as $BF_4^-$ or $PF_6^-$, are preferable for use. As the metallic salt which forms a double salt in combination with the second-mentioned acidic residue, $ZnCl_2$, $CdCl_2$, and $SnCl_2$ can be employed.

Specific examples of the diazo compounds represented by the general formula (I) are as follows:

(I) - 1

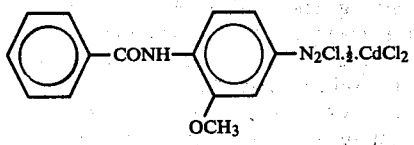

(I) - 2

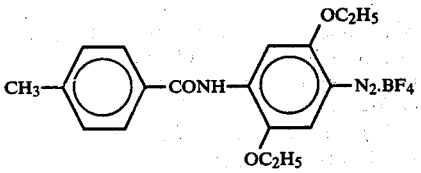

(I) - 3

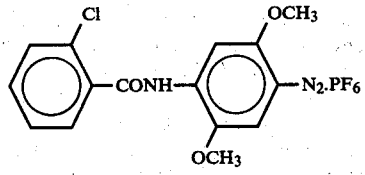

Specific examples of the diazo compounds represented by the general formula (II) are as follows:

(II) - 1

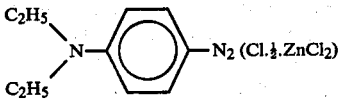

(II) - 2

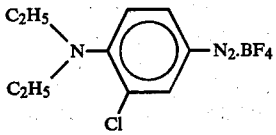

(II) - 3

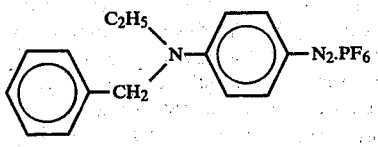

(II) - 4

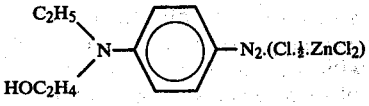

-continued (II) - 5

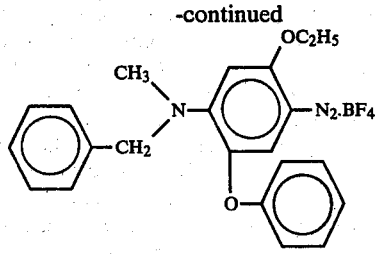

Specific examples of the diazo compounds represented by the general formula (III) are as follows:

(III) - 1

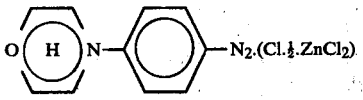

(III) - 2

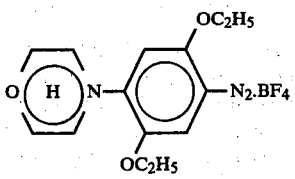

(III) - 3

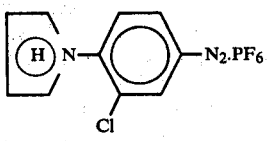

(III) - 4

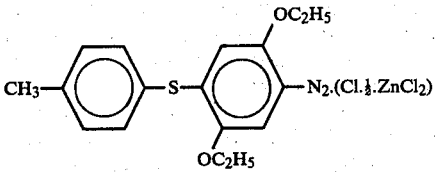

(III) - 5

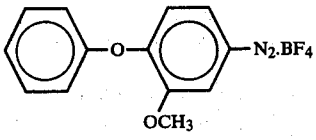

In the present invention, in order to obtain thermosensitive recording products with excellent preservability, it is preferable to employ the diazo compounds in the form of water-insoluble salts, for instance, the salts of fluorine-containing acids, such as $HBF_4$ and $HPF_6$.

Examples of the couplers used in the present invention are as follows:

Phenol derivatives such as phenol, resorcinol, methylresorcinol, 4,4-bis-resorcinol, phloroglucinol, resorcylic acid, phloroglucinolcarboxylic acid, 2-methyl-5-methoxy-1,3-dihydroxybenzene, 4-N,N-dimethylphenol, 2,6-dimethyl-1,3,5-trihydroxybenzene, 2,6-dihydroxybenzoic acid and 2,6-dihydroxy-3,5-dibromo-4-methoxy benzoic acid; and naphthol derivatives such as α-naphthol, β-naphthol, 4-methoxy-1-naphthol, 2,3-dihydroxynaphthalene, 2,3-dihydroxynaphthalene-6-sodium sulfonate, 2-hydroxy-3-propylmorpholinonaphthoic acid, 2-hydroxy-3-naphtho-o-toluidide, and 2-hydroxy-3-naphthoic acid morpholinopropylamide.

With respect to the use of couplers, the present invention is not limited to the couplers given above.

Furthermore, in the present invention, a thermo-fusible material is added to the thermosensitive coloring layer in an amount of 2 to 30 parts by weight, preferably 5 to 10 parts by weight, to one part by weight of the diazo compound employed, in order to accelerate the coloring reaction upon heat application to the thermosensitive recording material. The thermo-fusible material promotes the fusing of the layer when heat is applied thereto, whereby the interaction of the diazo compound and the coupler in the thermosensitive recording layer is speedily effected and, accordingly, the coloring reaction can be initiated upon application of heat to the thermosensitive recording material.

The above-mentioned amounts of the thermo-fusible material are particularly suitable in the case of high speed printing in facsimile apparatus or the like. If the amount of the thermo-fusible material is less than 2 parts by weight, high coloring efficiency cannot be obtained, while higher amounts than 30 parts by weight may lead to blurred images.

It is preferable that the thermo-fusible material have a melting or softening point ranging from 50° C. to 250° C. A thermo-fusible material with a melting or softening point below 50° C. would cause poor long-term preservation in the thermosensitive recording material, while a thermo-fusible material having a melting or softening point above 250° C. will lead to insufficient thermal response to a thermal head for practical use.

Examples of the thermo-fusible materials for use in the present invention are as follows:

Alcohol derivatives such as 2-tribromethanol, 2,2-dimethyl-trimethylene glycol and cyclohexane-1,2-diol; acid derivatives such as malonic acid, glutaric acid, maleic acid, and methylmaleic acid; animal waxes such as beeswax and shellac wax; vegetable waxes such as carnauba wax; mineral waxes such as montan wax; petroleum waxes such as paraffin wax and microcrystalline wax; and other synthetic waxes such as polyalcohol esters of higher fatty acids, higher fatty ketones, higher fatty amines, higher fatty amides, condensates of fatty acids and amines, condensates of aromatic acids and amines, synthetic paraffins, paraffin chlorides, metal salts, etc.

Furthermore, in the present invention, a thermo-fusible or thermo-softening binder agent is employed for binding each component together in the thermosensitive coloring layer and for stably supporting the thermosensitive coloring layer on the support material.

With respect to the melting or softening point of the binder agent, the same concerns as in the case of the thermo-fusible material can be applied to the binder agent. That is, it is preferable that the binder agent have a melting or softening point ranging from 50° C. to 250° C. A binder agent with a melting or softening point below 50° C. would cause poor long-term preservation in the thermosensitive recording material, while a binder agent having a melting or softening point above 250° C. will lead to insufficient thermal response to the thermal head for practical use.

Examples of thermo-fusible or thermo-softening binder agents which can be used in the present invention include: polyvinyl acetate, polyvinyl chloride, a vinyl chloride/vinyl acetate copolymer, acrylic resins, acrylic ester, polystyrene, polybutadienes, and a styrene/butadiene/acrylic acid copolymer.

Such a binder agent is not necessarily used alone, but other binder agents may be added as a mixture (generally in an amount of less than 30%, w/w) as far as they will not interfere with the object of the present invention, so as to provide stronger binding of each component in the layer to the support material.

Examples of the above-mentioned other binder agents are listed below.

Polyvinyl alcohol, sodium polyacrylate, polyvinylacrylamide, polybutadiene, polyethyleneimine, polyethylene oxide, polyacrylamide, casein, gelatin, starch and starch derivatives, gum arabi, sodium alginate, zinc caseinate, pectin, polyvinyl pyrrolidone, carboxymethyl cellulose, chlorinated rubber, polyurethane, and water-soluble, organic solvent-soluble or water-dispersion-type resins such as urea-formalin resin, phenol resins, a styrene-butadiene resin, acrylic resin, or vinyl acetate resin. Each of these binder agents can be employed as the case may require.

According to the present invention, auxiliary components such as acidic materials, basic materials, fillers and others may be added if necessary.

Acidic materials are for preventing a coupling reaction during storage and to give better preservation. The following are examples of acidic materials:

Tartaric acid, citric acid, boric acid, lactic acid, gluconic acid and sulfuric acid.

Basic materials are for promoting the coupling reaction upon heating. The following are examples of basic materials:

Caustic alkali and alkaline carbonates such as sodium hydroxide, calcium hydroxide and potassium carbonate. Materials which become basic when heated may also be used, examples of which include urea, thiourea and their derivatives, alkaline salts of trichloroacetic acid, ammonium chloride, ammonium sulfate and ammonium citrate.

Fillers are added for improving the compatibility of the thermosensitive coloring layer with the thermal head which applies heat to the layer for image formation. The following are examples of such fillers:

Organic and inorganic materials such as microparticles of styrene resin, microparticles of urea-formalin condensate resin, aluminum hydroxide, magnesium hydroxide, calcium carbonate, titanium, talc, kaoline, silica and aluminum.

The following auxiliary agents may also be used to hinder coloring during storage of the recording material: zinc chloride, zinc sulfate, sodium citrate, guanidine sulfate, calcium gluconate, sorbitol and saccharose.

Diazo-type thermosensitive recording materials according to the present invention can be obtained by the following procedure.

A diazo compound layer formation liquid and a coupler layer formation liquid are prepared by dissolving or dispersing the above described components in a appropriate solvent for each layer. One of these liquids is coated on a conventional support material, such as paper, synthetic paper, plastic film, or metal-laminated sheet, and dried, and the other liquid is then coated on the dried layer, so that the diazo compound layer and the coupler layer are formed in the form of double layers on the support material. Alternatively, a mixture of those liquids is coated on the support material and dried, so that a single thermosensitive coloring layer is formed on the support material.

In the present invention, solvents for dissolving or dispersing the components in each layer are selected in accordance with the properties of each layer.

Examples of such solvents for use in the present invention are aqueous solvents, such as water and mixed solvents containing organic solvents and water; non-polar organic solvents, such as benzene, toluene, xylene, n-hexane, n-heptane, cyclohexane and kerosene; and polar organic solvents, such as methyl isobutylketone, methyl cellosolve, acetone, methyl ethyl ketone and dimethyl ether.

In the present invention, when the diazo compound layer and the coupler layer are formed in the form of double layers on the support material, in order to prepare a thermosensitive coloring layer that can be preserved during lengthy storage, an appropriate solvent must be selected for use in the upper layer, with the properties of the components contained in the lower layer being taken into consideration.

For instance, when a coupler layer is first formed on the support material and a diazo compound layer is then formed on the coupler layer, it is necessary that the solvent for the diazo compound layer not dissolve the coupler in the coupler layer. Otherwise, the coupler will react with the diazo compound to form a color during the coating of the diazo compound layer on the coupler layer.

In the present invention, the diazo compound and the coupler can be contained either in a "consecutive state" or in an "unconsecutive state" in each layer.

The "consecutive state" means a state in which a diazo compound (or a coupler) is uniformly present in the layer. This state can be created by dissolving the diazo compound (or the coupler) in a solvent and then forming a layer by coating that solution.

In contrast, the "unconsecutive state" means a state in which the diazo compound (or coupler) is present in the state of particles dispersed separately in the layer. This state can be created by dispersing a diazo compound (or a coupler) in a solvent which cannot dissolve, but can disperse, the diazo compound (or the coupler), and then forming a layer by coating that dispersion.

In the present invention, when a thermosensitive coloring layer in which both the diazo compound and the coupler are contained is prepared in order to obtain a thermosensitive recording material which is excellent in preservability during lengthy storage, it is preferable that either the diazo compound or the coupler be present in the state of undissolved solid particles.

When the thermosensitive coloring layer consists of double layers, the layering order of the two layers relative to a support material can be chosen as desired, that is, the diazo compound layer can be formed on the coupler layer or vice versa. It is not always necessary that the diazo compound layer be in contact with the coupler layer, but an intermediate layer made of a petroleum resin, or other auxiliary layer can be placed between the two layers. Such a layer can also be placed on top of the thermosensitive recording material or as the lowermost layer on the support material. As a support material, for instance, paper, synthetic paper, plastic film or a metal-laminated material can be employed as mentioned previously.

In addition to the above, a variety of layer constructions employed in the present invention will now be listed. The symbols in the list shown below signify the following:

D: Diazo compound
C: Coupler
X: Petroleum resin
Y: Thermo-fusible or thermo-softening material, filler or other auxiliary components ( ) means a layer comprising component(s) indicated by the symbol(s) contained in ( ). For instance, (D): Diazo compound layer
(D+X): Layer comprising a diazo compound and a petroleum resin
(D+Y): Layer comprising a diazo compound and a thermo-fusible, thermo-softening material, a filler or other auxiliary component.

$(C)/(D+X)$ (1)

$(D+X)/(C)$ (2)

$(D)/(C+X)$ (3)

$(C+X)/(D)$ (4)

$(C+X)/(D+X)$ (5)

$(D+X)/(C+X)$ (6)

$(C+X)/(D+X+Y)$ (7)

$(D+X)/(C+X+Y)$ (8)

$(C+X+Y)/(D+X+Y)$ (9)

$(D+X+Y)/(C+X+Y)$ (10)

$(C)/(Y)/(D+X)$ (11)

$(C)/(X)/(D+X)$ (12)

$(D+X)/(Y)/(C)$ (13)

$(D+X)/(X)/(C)$ (14)

$(D)/(Y)/(C+X)$ (15)

$(D)/(X)/(C+X)$ (16)

$(C+X)/(Y)/(D)$ (17)

$(C+X)/(X)/(D)$ (18)

$(C+X)/(Y)/(D+X)$ (19)

$(C+X)/(X)/(D+X)$ (20)

$(C+X)/(X)/(D+Y)$ (21)

$(D+X)/(X)/(C+X)$ (22)

$(C)/(X+Y)/(D+Y)$ (23)

$(D)/(X+Y)/(C+Y)$ (24)

$(Y)/(C+X)/(D)/(X+Y)$ (25)

$(Y)/(C+X)/(D+X)/(X+Y)$ (26)

$(C+X)/(D+X)/(C)/(X+Y)$ (27)

$(Y)/(C+X)/(D+X)/(X)/(Y)$ (28)

$(Y)/(C+X)/(D+X)/(C+Y)/(Y)$ (29)

The thermosensitive recording material according to the present invention can be employed in various fields, in particular, as the output recording sheets for facsimile apparatus and computers, in which rapid recording is required.

Further, in the thermosensitive recording material, once images are formed, they can be fixed permanently by exposing the thermosensitive recording material to light. By this exposure, the unreacted diazo compound present in the non-image areas is decomposed, so that no images can be formed thereafter even if heat is applied later on. Therefore, the thermosensitive recording material according to the present invention can be employed in the fields in which high recording reliability is required, for instance, for preparing negotiable securities, merchandise coupons, entrance tickets, certificates, payment slips, or the like.

The preferred embodiments of the present invention will be described more specifically by the following examples:

EXAMPLES 1 TO 3 AND COMPARATIVE EXAMPLES 1 TO 3

(1) Coupler Liquids (Dispersions and Solutions).

| (Coupler Liquid C-1) | Parts by Weight |
|---|---|
| Phloroglucinol | 5 |
| Stearamide | 5 |
| Calcium carbonate | 5 |
| 20% aqueous solution of polyvinyl alcohol | 5 |
| Water | 20 |

The above components were dispersed in a ball mill for 24 hours, so that Coupler Liquid C-1 was prepared.

| (Coupler Liquid C-2) | Parts by Weight |
|---|---|
| 2,3-dihydroxynaphthalene-6-sodium sulfonate | 7 |
| Stearamide | 4 |
| Petroleum resin (Trade name: "Hi-rez", made by Mitsui Petrochemical Industries, Ltd.) | 11 |
| Tartaric acid | 1 |
| n-Hexane | 20 |

The above components were dispersed in a ball mill for 24 hours, so that Coupler Liquid C-2 was prepared.

| (Coupler Liquid C-3) | Parts by Weight |
|---|---|
| 2,6-dihydroxy-3,5-dibromo-4-methoxy benzoic acid | 8 |
| Calcium gluconate | 4 |
| Polyethylene glycol | 10 |
| Water | 78 |

The above components were dissolved, so that Coupler Liquid C-3 was prepared.

(2) Diazo Liquids.

| (Diazo Liquid D-1) | Parts by Weight |
|---|---|
| 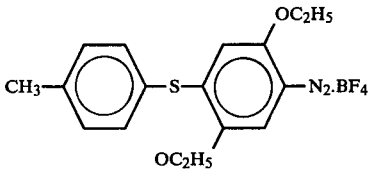 | 5 |

-continued

| (Diazo Liquid D-1) | Parts by Weight |
|---|---|
| Calcium carbonate | 5 |
| Petroleum resin (Trade name: "Arkon", made by Arakawa Kagaku Kogyo Co., Ltd.) | 10 |
| n-Hexane | 20 |

The above components were dispersed in a ball mill for 24 hours, so that Diazo Liquid D-1 was prepared.

| (Diazo Liquid D-2) | Parts by Weight |
|---|---|
| 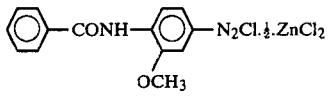 | 5 |
| Calcium carbonate | 5 |
| Petroleum resin (Trade name: "Hiresin", made by Toho Sekiyu Jushi Co., Ltd.) | 10 |
| Sodium trichloroacetate | 5 |
| n-Hexane | 20 |

The above components were dispersed in a ball mill for 24 hours, so that Diazo Liquid D-2 was prepared.

| (Diazo Liquid D-3) | Parts by Weight |
|---|---|
| 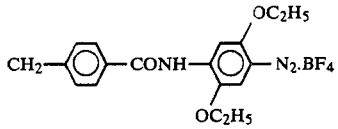 | 5 |
| Calcium carbonate | 5 |
| Petroleum resin (Trade name: "Arkon") | 10 |
| Mixture of methyl isobutyl ketone and toluene (70:30) (w/w) | 20 |

The above components were dispersed in a ball mill for 24 hours, so that Diazo Liquid D-3 was prepared.

(3) Intermediate layer Formation Liquid.

| (Intermediate Layer Formation Liquid I-I) | Parts by Weight |
|---|---|
| Stearamide | 5 |
| Petroleum resin (Trade Name: "Arkon") | 5 |
| Toluene | 90 |

The above components were dispersed in a ball mill for 24 hours, to that Diazo Liquid I-1 was prepared.

(4) For use in comparative examples, Diazo Liquids D-4, D-5, Coupler Liquid C-4, and Intermediate Layer Formation Liquid I-2 were prepared by dispering the components of each liquid in a ball mill for 24 hours.

| (Diazo Liquid D-4) | Parts by Weight |
|---|---|
| 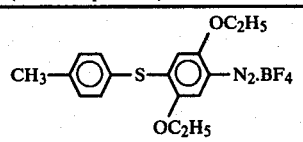 | 5 |
| Calcium carbonate | 5 |
| Cyclohexane | 20 |

| (Diazo Liquid D-5) | Parts by Weight |
|---|---|
| 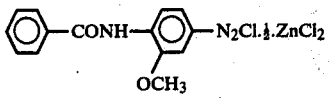 | 5 |
| Calcium carbonate | 5 |
| 20% aqueous solution of polyvinyl alcohol | 10 |
| Sodium trichloroacetate | 5 |
| Water | 20 |

| (Diazo Liquid D-6) | Parts by Weight |
|---|---|
| 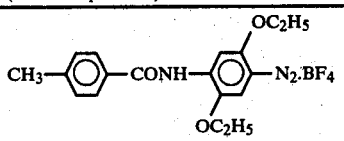 | 5 |
| Calcium carbonate | 5 |
| Polystyrene (Trade Name: Picolastic D-160, made by Esso Standard Petroleum Co., Ltd.) | 10 |
| Mixture of methyl isobutyl ketone and toluene (70:30) (w/w) | 20 |

| (Coupler Liquid C-4) | Parts by Weight |
|---|---|
| 2,3-dihydroxynaphthalene-6-sodium sulfonate | 7 |
| Stearamide | 4 |
| Tartaric acid | 1 |
| 20% aqueous solution of polyvinyl alcohol | 11 |
| n-Hexane | 20 |

| (Intermediate Layer Formation Liquid I-2) | Parts by Weight |
|---|---|
| Stearamide | 5 |
| Polystyrene (Trade Name: Picolastic D-160) | 5 |
| Toluene | 90 |

Each of the above-described liquids was applied to the surface of high quality paper (ca. 50 g/m$^2$) in the combinations listed in Table 1, with a solid component deposition in each layer being in the range of 2 g/m$^2$ to 3 g/m$^2$. Each of the thus prepared recording materials was subjected to drying and calendering so as to have a smoothness of 400 seconds in terms of Beck's smoothness, whereby Examples 1 through 3 of a thermosensitive recording material according to the present invention and Comparative Examples 1 through 3 of a thermosensitive recording material were prepared.

TABLE 1

| | Thermosensitive Recording Material | | |
|---|---|---|---|
| | 1st Layer | 2nd Layer | 3rd Layer |
| Example No. | | | |
| 1 | C-1 | D-1 | |
| 2 | C-2 + D-2 (1:1) | | |
| 3 | C-3 | I-1 | D-3 |
| Comparative Example | | | |
| 1 | C-1 | D-4 | |
| 2 | C-4 | D-5 | |
| 3 | C-3 | I-2 | D-6 |

In the thermosensitive recording materials thus obtained, images were formed by a commercially available facsimile apparatus (Rifax 303 made by Ricoh Company, Ltd.) under G-II mode. The images were then fixed by complete exposure to light using a commercially available diazo copying machine (Ricopy High-Start made by Ricoh Company, Ltd.). After the image fixing, the background of each thermosensitive recording material was no longer colored by application of heat thereto and the fixed images did not disappear when they were brought into contact with ordinarily available organic solvents.

Each image density obtained was determined by a Macbeth densitometer (RD-514).

The initial background density of each thermosensitive recording material was then measured by the Macbeth densitometer (RD-514) immediately after complete exposure of each diazo recording material to light, preceded by application of the coating liquids and drying the same.

The preservability of each diazo thermosensitive recording material was also measured by measuring the background density after exposure to light, preceded by a forced test in which the material was kept at 40° C. for 24 hours under relative humidity of 90%, as measured by Macbeth densitometer (RD-514). A value below 0.20 obtained in these forced tests is comparable to good preservation for more than 2 years at room temperature and room humidity in the dark.

The results are summarized in Table 2.

TABLE 2

| Example | Developed Color | I. D. | Preservability: Initial B.D. | Preservability: B.D. after Forced Test |
|---|---|---|---|---|
| Example | | | | |
| 1 | Black | 1.10 | 0.10 | 0.14 |
| 2 | Violet | 1.05 | 0.10 | 0.18 |
| 3 | Dark Brown | 1.05 | 0.09 | 0.13 |
| Comparative Example | | | | |
| 1 | Black | 1.12 | 0.11 | 0.27 |
| 2 | Violet | 1.03 | 0.10 | 0.34 |
| 3 | Dark Brown | 0.87 | 0.09 | 0.23 |

(Note)
I.D. Image Density
B.D. Background Density

As can be seen from the above, all the thermosensitive recording materials according to the present invention in Examples 1 through 3 were better in preservability than the thermosensitive recording materials in Comparative Examples 1 through 3.

What is claimed is:

1. In a diazo-type thermosensitive recording material comprising a support material and a thermosensitive coloring layer formed thereon, which thermosensitive coloring layer comprises a diazonium compound and a coupler capable of forming an azo dye by reaction with said diazonium compound, the improvement wherein said thermosensitive coloring layer comprises a petroleum resin.

2. A diazo-type thermosensitive recording material as claimed in claim 1, wherein the softening point of said petroleum resin is in the range of 50° C. to 150° C.

3. A diazo-type thermosensitive recording material as claimed in claim 1, wherein said petroleum resin is an oligomer with a number-average molecular weight ranging from 300 to 3000.

4. A diazo-type thermosensitive recording material as claimed in claim 1, wherein the amount of said petroleum resin employed in said thermosensitive coloring layer is in the range of 0.2 to 5.0 parts by weight, with respect to one part by weight of the sum of all other solid components contained in said thermosensitive coloring layer.

5. A diazo-type thermosensitive recording material as claimed in claim 1, wherein said petroleum resin is a member selected from the group consisting of copolymer of $C_8$–$C_{10}$ aromatic hydrocarbon fractions and acrylonitrile; copolymer of dicyclopentadiene and maleic anhydride; hydrolyzed decanolated copolymer of $C_{13}$ hydrocarbon fractions and acrylonitrile; turpentine oil copolymer; copolymer of cyclopentadiene and dicyclopentadiene; cumarone-indene copolymer; hydrogenated $C_4$–$C_{10}$ petroleum resin; $C_4$–$C_{10}$ maleic petroleum resin; $C_5$ hydrocarbon fraction polymer; isoprene dimer; polymer of $C_8$–$C_{10}$ aromatic hydrocarbon fractions; copolymer of $C_4$–$C_5$ hydrocarbon fraction and $C_8$–$C_{10}$ aromatic hydrocarbon fractions; and copolymer of $C_4$–$C_5$ hydrocarbon fraction and styrene type compounds.

6. A diazo-type thermosensitive recording material as claimed in claim 1, wherein said diazonium compound is a member selected from the group consisting of the diazonium compounds represented by formulae (I), (II) or (III)

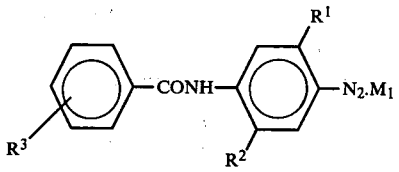

(I)

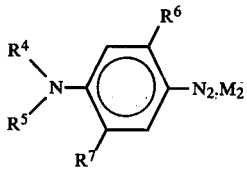

(II)

-continued

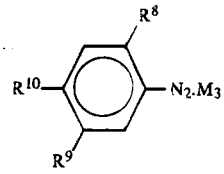

(II)

wherein $R^1$, $R^6$ and $R^8$ each represent hydrogen, a halogen, an alkyl group or alkoxy group having one to five carbon atoms,

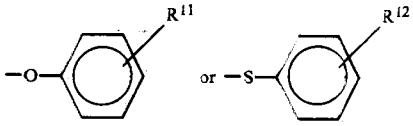

wherein $R^{11}$ and $R^{12}$ are the same as $R^2$;

$R^2$, $R^3$ and $R^9$ each represent hydrogen, a halogen, or an alkyl or alkoxy group having one to five carbon atoms;

$R^4$ and $R^5$ represent an identical or different alkyl group or hydroxyalkyl group with one to five carbon atoms, a hydroxyalkyl group or

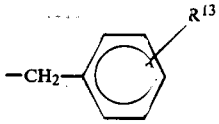

$R^{13}$ is hydrogen, an alkyl or alkoxy group with one to three carbon atoms or a halogen;

$R^7$ represents hydrogen, a halogen, a trifluoromethyl group, an alkyl or alkoxy group with one to five carbon atoms, or

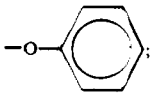

$R^{10}$ represents

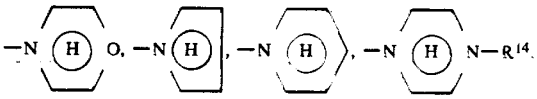

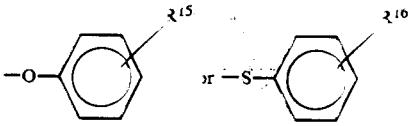

wherein $R^{14}$, $R^{15}$ and $R^{16}$ are the same as $R^{13}$;

$M^1$, $M^2$ and $M^3$ each represent an acidic residue.

7. A diazo-type thermosensitive recording material as claimed in claim 6, wherein said acidic residue represented by $M^1$, $M^2$ or $M^3$ is in the form of a double salt in combination with a metallic salt.

8. A diazo-type thermosensitive recording material as claimed in claim 1, wherein said coupler is a phenolic material.

9. A diazo-type thermosensitive recording material as claimed in claim 1, wherein said thermosensitive coloring layer further comprises a thermo-fusible material with a melting or softening point ranging from 50° C. to 250° C., in an amount of 2 to 30 parts by weight with respect to one part by weight of said diazonium compound.

10. A diazo-type thermosensitive recording material as claimed in claim 9, wherein said thermo-fusible material is a wax or wax-like material selected from the group consisting of alcohol derivatives, animal waxes, vegetable waxes, petroleum waxes and synthetic waxes.

11. A diazo-type thermosensitive recording material as claimed in claim 1, wherein said thermosensitive coloring layer further comprises a thermo-softening binder agent with a softening point ranging from 50° C. to 250° C.

12. A diazo-type thermosensitive recording material as claimed in claim 11, wherein said thermo-softening binder agent is a member selected from the group consisting of polyvinyl acetate, polyvinyl chloride, a vinyl chloride/vinyl acetate copolymer, acrylic resins, acrylic ester, polystyrene, polybutadienes, a styrene/-butadiene/acrylic acid copolymer, polyvinyl alcohol, sodium polyacrylate, polyvinylacrylamide, polybutadiene, polyethyleneimine, polyethylene oxide, polyacrylamide, casein, gelatin, starch and starch derivatives, gum arabic, sodium alginate, zinc caseinate, pectin, polyvinyl pyrrolidone, carboxymethyl cellulose, chlorinated rubber, polyurethane, urea-formaldehyde resin, phenol resin and a styrene-butadiene resin.

13. A diazo-type thermosensitive recording material as claimed in claim 1, wherein said thermosensitive coloring layer comprises a plurality of layers, in which said diazonium compound and said coupler are contained in separate layers, and said petroleum resin is contained in at least one of said layers.

14. A diazo-type thermosensitive recording material as claimed in claim 1, wherein said thermosensitive coloring layer comprises a diazonium compound layer containing said diazonium compound, a coupler layer containing said coupler, and an intermediate layer for separating said two layers, disposed therebetween, and said petroleum resin is contained in at least said intermediate layer.

15. A diazo-type thermosensitive recording paper comprising a support paper and a thermosensitive coloring layer on said support paper, said thermosensitive coloring layer comprising a diazonium compound and a coupler which are capable of reacting with each other to form an azo dye, said thermosensitive coloring layer also containing a petroleum resin having a softening point in the range of from 50° C. to 150° C., the amount of said petroleum resin in said thermosensitive coloring layer being in the range of from 0.2 to 5 parts by weight, per one part by weight of the sum of all other solid components contained in said thermosensitive coloring layer, said petroleum resin being effective to separate said diazonium compound and said coupler from each other and thereby prevent the reaction between them during storage of the recording paper, said petroleum resin being meltable when a heated thermal head is applied to the recording paper in order to effect the reaction between said diazonium compound and said coupler to form a visible azo dye image.

* * * * *